US007762773B2

(12) United States Patent
Liang

(10) Patent No.: US 7,762,773 B2
(45) Date of Patent: Jul. 27, 2010

(54) TURBINE AIRFOIL COOLING SYSTEM WITH PLATFORM EDGE COOLING CHANNELS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 913 days.

(21) Appl. No.: 11/526,257

(22) Filed: Sep. 22, 2006

(65) Prior Publication Data

US 2010/0124508 A1 May 20, 2010

(51) Int. Cl.
*F01D 5/18* (2006.01)

(52) U.S. Cl. ..... 416/97 R; 415/115; 415/119; 416/190; 416/500

(58) Field of Classification Search ..... 415/115, 415/119; 416/97 R, 190, 500
See application file for complete search history.

(56) References Cited

U.S. PATENT DOCUMENTS 3,037,741 A * 6/1962 Tuft ..... 416/221
4,111,603 A * 9/1978 Stahl ..... 416/95
4,872,812 A * 10/1989 Hendley et al. ..... 416/190
5,156,528 A * 10/1992 Bobo ..... 416/190
5,217,348 A 6/1993 Rup, Jr. et al.
5,382,135 A 1/1995 Green
5,460,486 A 10/1995 Evans et al.
5,478,207 A * 12/1995 Stec ..... 416/219 R
6,254,333 B1 7/2001 Merry
6,447,250 B1 9/2002 Corrigan et al.
6,478,544 B2 * 11/2002 Brandl et al. ..... 416/190
6,582,195 B2 6/2003 Davidson
6,659,725 B2 * 12/2003 Yeo et al. ..... 416/190
6,860,108 B2 3/2005 Soechting et al.
6,966,750 B2 11/2005 Shiozaki et al.
7,001,141 B2 2/2006 Cervenka
7,004,720 B2 2/2006 Synnott et al.
7,021,898 B2 * 4/2006 Elliott et al. ..... 416/193 A
2004/0109764 A1 6/2004 Tiemann
2005/0100437 A1 5/2005 Phillips et al.
2005/0135920 A1 6/2005 Synnott et al.
2006/0078417 A1 4/2006 Benton

* cited by examiner

*Primary Examiner*—Igor Kershteyn

(57) ABSTRACT

A turbine airfoil of a turbine engine having cooling channels positioned on side surface edges of a platform of the airfoil. The platform may include at least one angled side surface that may be aligned with a side surface of a platform of an adjacent turbine blade. The airfoil may include a suction side edge formed from a first surface at an obtuse angle relative to an upper surface of the platform and a second surface at an obtuse angle relative to a bottom surface of the platform. One or more film cooling slots may be positioned in the first surface and may include a diffusion portion. A damper may also be positioned in a groove between the second surface and an adjacent platform. The damper may include cooling slots on a side surface proximate to the second surface of the suction side edge.

18 Claims, 4 Drawing Sheets

TURBINE AIRFOIL COOLING SYSTEM WITH PLATFORM EDGE COOLING CHANNELS

FIELD OF THE INVENTION

This invention is directed generally to turbine airfoils, and more particularly to cooling systems in hollow turbine airfoils usable in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. Some of the cooling fluids are passed through the root and into the cavity between adjacent turbine blades to cool the platforms of the blades. The cooling fluids may be exhausted through gaps between adjacent blades and may create film cooling. The gaps are typically formed between side surfaces of the platforms that are generally parallel to each other and parallel to a longitudinal axis of the turbine blade. Oxidation and erosion of the side surfaces of the platforms often occurs and results in a greater flow of cooling fluids through the gap. The excessive fluid flow creates more turbulence in the film cooling layer and prevents adequate formation of the film cooling layer. Thus, a need exists for reducing the oxidation and erosion problems that typically occur on the side surfaces of platforms of turbine blades.

SUMMARY OF THE INVENTION

This invention relates to a turbine airfoil that is used in turbine engines and includes an internal cooling system with a portion of the cooling system positioned on side surfaces of a platform of the turbine airfoil. In particular, the turbine airfoil may include side surfaces proximate to the suction side and pressure side of the turbine airfoil that enhance cooling of the platform and promote the creation of film cooling boundary layers proximate to an upper surface of the platform. The side surfaces may be angled relative to the upper surface to increase the effectiveness of the interface between platforms of adjacent turbine airfoils regulating the flow of cooling fluids to reduce oxidation and erosion.

The turbine airfoil may be formed from a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil. The airfoil may also include a platform positioned at the intersection of the generally elongated, hollow airfoil and the root. The platform may include a leading edge, a trailing edge opposite the leading edge, a pressure side edge positioned proximate to a pressure side of the generally elongated, hollow airfoil and a suction side edge positioned proximate to a suction side of the generally elongated, hollow airfoil. The suction side edge may be positioned at an acute angle relative to a longitudinal axis of the platform.

The suction side edge may be formed from at least two surfaces including a first surface positioned at an obtuse angle relative to an upper surface of the platform and a second surface positioned at an obtuse angle relative to a bottom surface of the platform and intersecting the first surface such that the first and second surfaces are positioned in different planes. The first surface may include one or more film cooling slots. The film cooling slot may include a diffusion portion positioned adjacent to the upper surface of the platform. The diffusion portion may include a first backside wall angled between about five degrees and about twenty five degrees from the first surface, and in particular, about ten degrees from the first surface. The diffusion portion may also include a first angled sidewall angled between about five degrees and about twenty five degrees from a first sidewall of the film cooling slot. The diffusion portion may also include a second angled sidewall angled between about five degrees and about twenty five degrees from a second sidewall of the film cooling slot that is positioned generally opposite to the first sidewall of the film cooling slot. In one embodiment, the first and second angled sidewalls may be angled at about ten degrees relative to the first and second sidewalls, respectively.

The turbine airfoil may also include one or more dampers positioned between the second surface adjacent to the bottom surface of the platform and a side surface of a platform of an adjacent turbine blade. The damper may have a suction side surface that is generally aligned with the second surface of the suction side edge and may have a pressure side surface that is generally aligned with a side surface of a pressure side edge of an adjacent turbine blade. One or more cooling slots may be positioned in the suction side and may extend generally parallel to the suction side of the damper.

An advantage of this invention is that the angled suction side and pressure side edges limit the flow of cooling fluids through the gap between platforms of adjacent turbine blades.

Another advantage of this invention is that the suction side edge or the pressure side edge, or both, may include film cooling slots for cooling the platforms.

Yet another advantage of this invention is that the film cooling slots alleviate oxidation and erosion problems associated with conventional turbine blade platform edges.

Another advantage of this invention is that the configuration produces a good film sub-layer with a highly effective local film layer.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
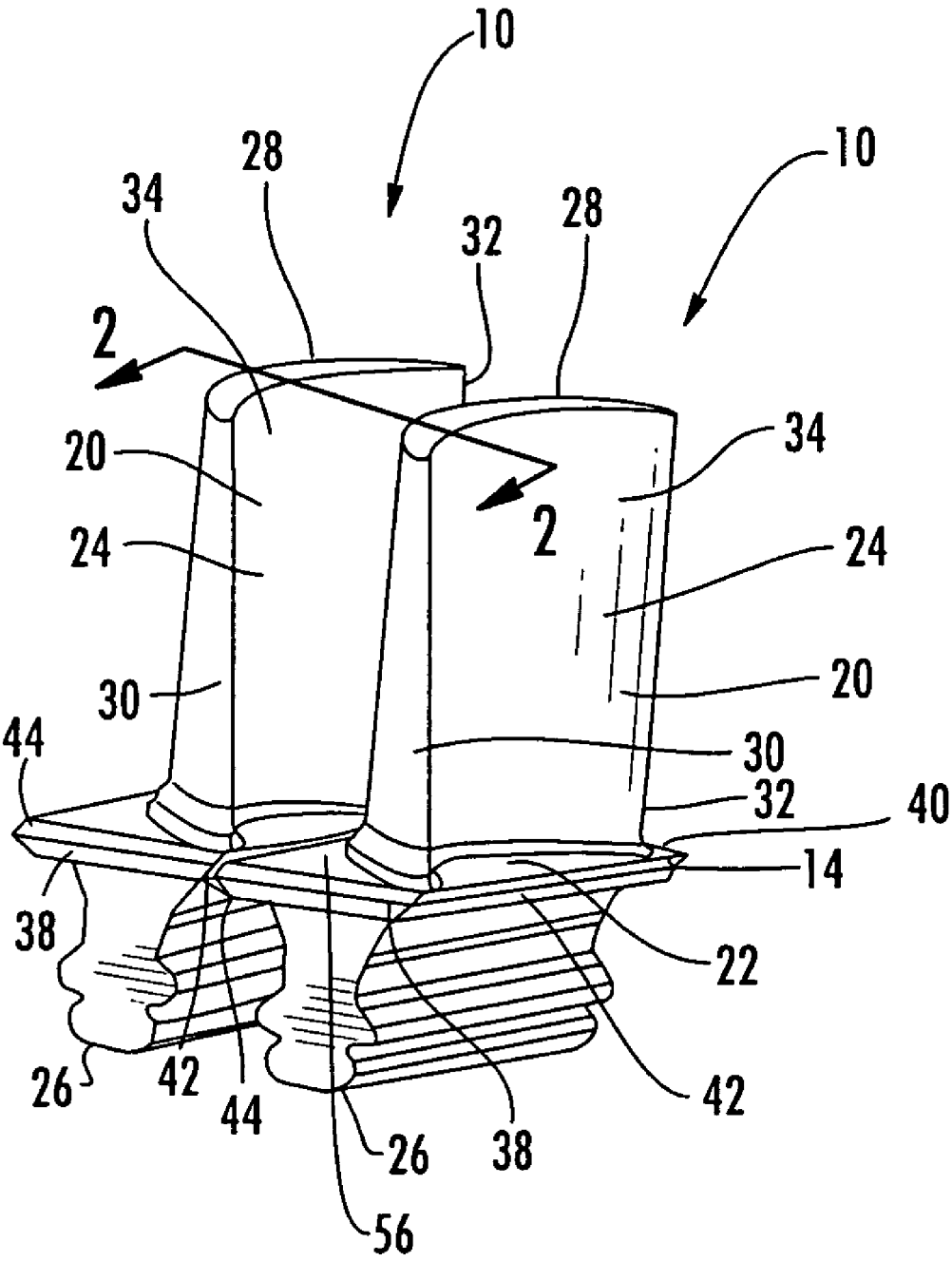
FIG. 1 is a perspective view of a turbine airfoil having features according to the instant invention.
Figure 2:
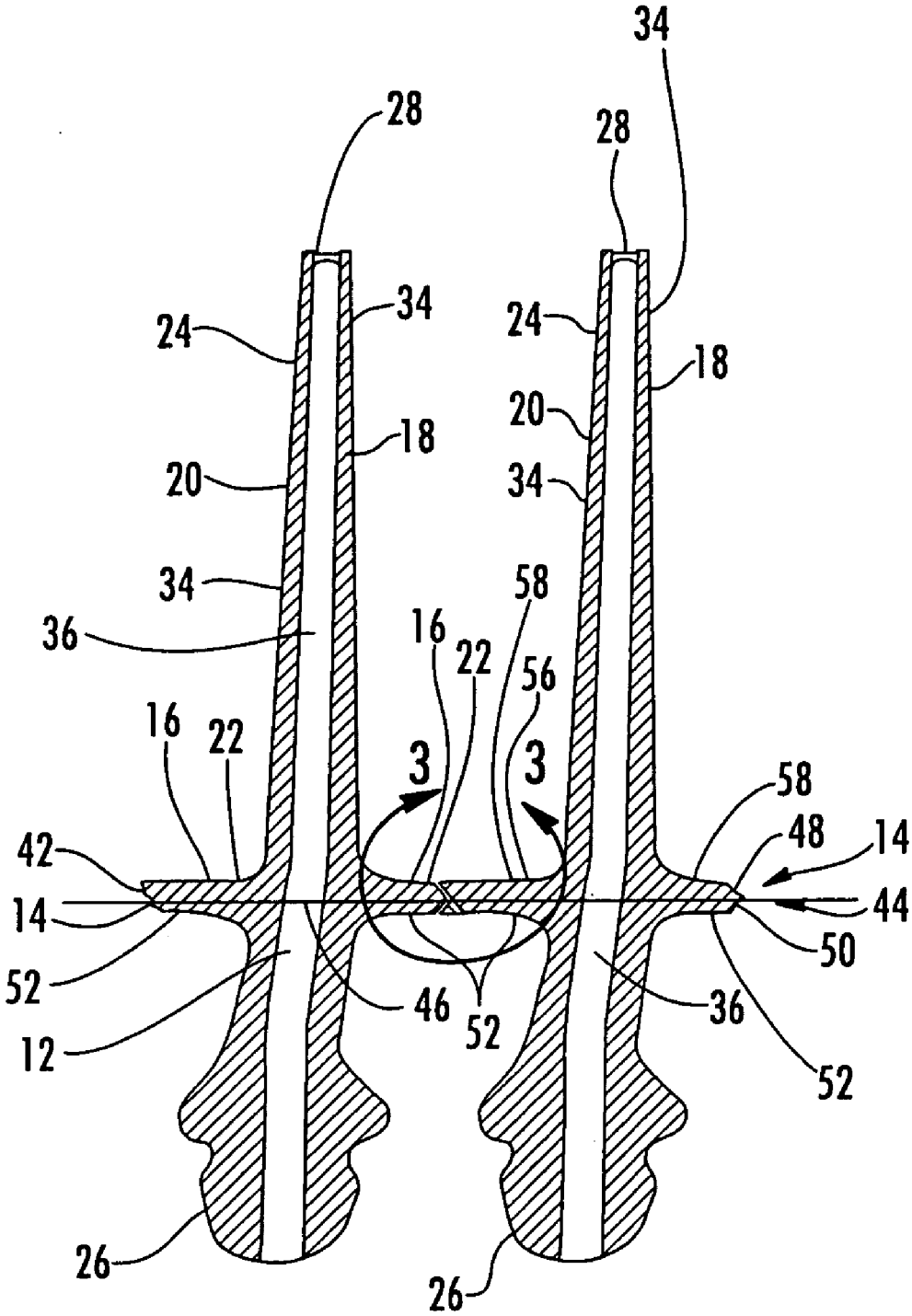
FIG. 2 is a cross-sectional view of the turbine airfoil shown in FIG. 1 taken along line 2-2 beside another turbine airfoil.
Figure 3:
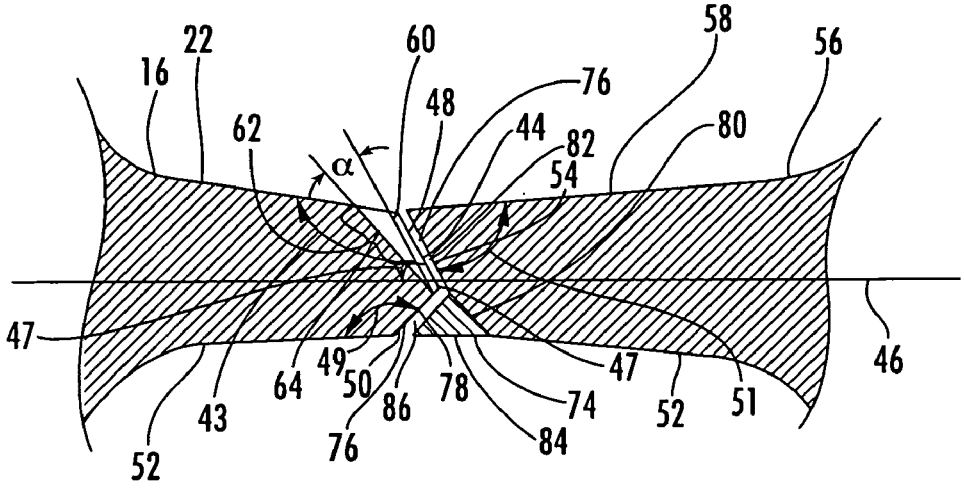
FIG. 3 is a detailed cross-sectional view of a portion of the platforms of the turbine airfoil shown in FIG. 2 along line 3-3.

As shown in FIGS. 1-6, this invention is directed to a turbine airfoil 10 that is used in turbine engines and includes a cooling system 12 that has a portion of the cooling system 12 positioned on side surfaces 14 of a platform 16 of the turbine airfoil 10. In particular, the turbine airfoil 10 may include side surfaces 14 proximate to the suction side 18 and pressure side 20 of the turbine airfoil 10 that enhance cooling and promote the creation of film cooling boundary layers proximate to an upper surface 22 of the platform 16. The side surfaces 14 may be angled relative to the upper surface 22 to increase the effectiveness of the interface between platforms of adjacent turbine airfoils, as shown in FIG. 3.

As shown in FIG. 1, the turbine airfoil 10 may be formed from a generally elongated, hollow airfoil 24 coupled to a root 26 at a platform 16. The turbine airfoil 10 may be formed from conventional metals or other acceptable materials. The generally elongated airfoil 24 may extend from the root 26 to a tip section 28 and include a leading edge 30 and trailing edge 32. Airfoil 24 may have an outer wall 34 adapted for use, for example, in a first stage of an axial flow turbine engine. Outer wall 34 may form a generally concave shaped portion forming the pressure side 20 and may form a generally convex shaped portion forming the suction side 18. The cooling system 12 of the turbine airfoil 10 may include a cavity 36, as shown in FIG. 2, positioned in inner aspects of the airfoil 24 for directing one or more gases, which may include air received from a compressor (not shown), through the airfoil 24 to reduce the temperature of the airfoil 24. The cavity 14 may be arranged in various configurations and is not limited to a particular flow path.

Figure 6:
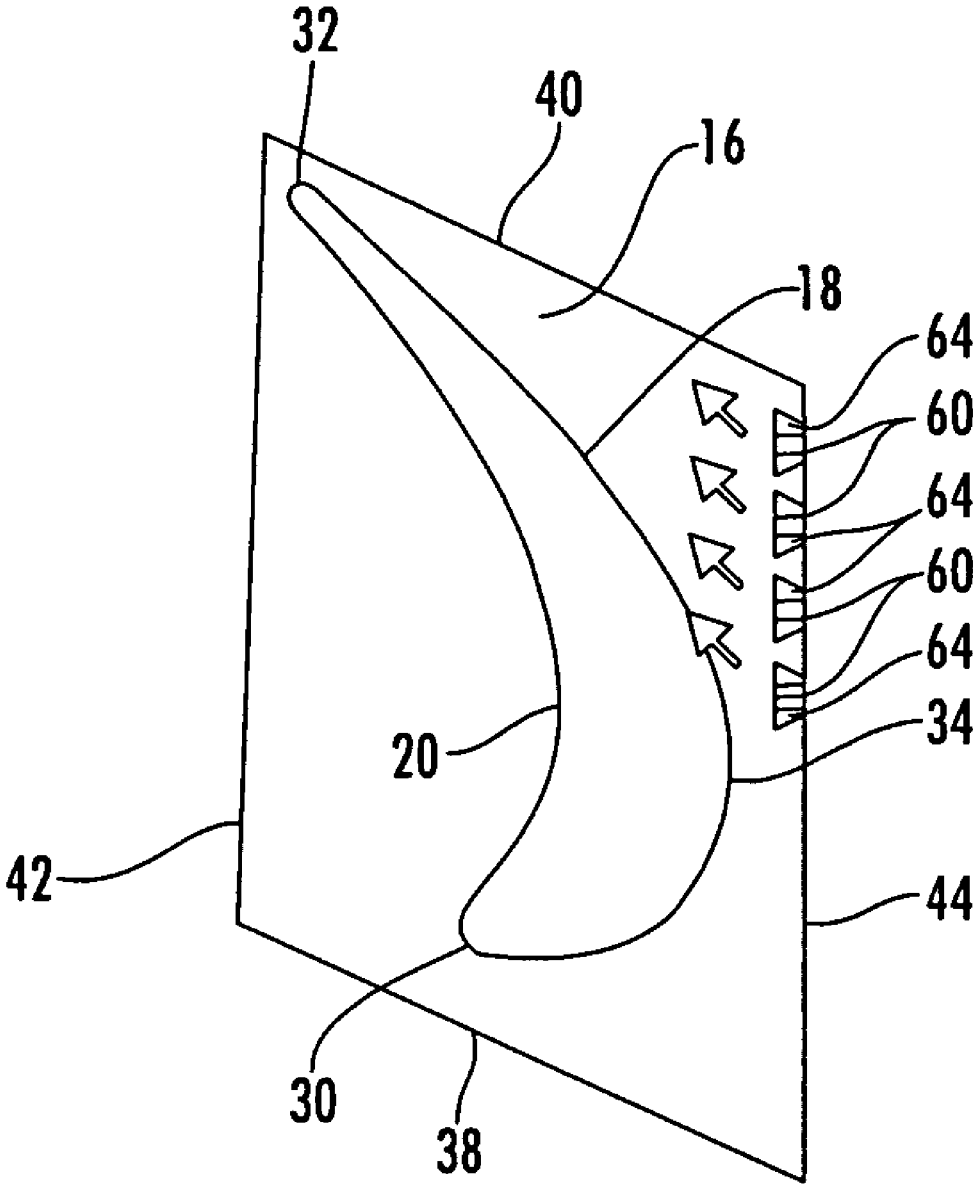
FIG. 6 is a top view of the turbine airfoil.

The platform 16 may be positioned at the intersection of the generally elongated, hollow airfoil 24 and the root 26. In one embodiment, the platform 16 may extend generally orthogonally to the generally elongated, hollow airfoil 24. As shown in FIG. 6, the platform 16 may include a leading edge 38, a trailing edge 40 opposite the leading edge 38, a pressure side edge 42 positioned proximate to a pressure side 20 of the generally elongated, hollow airfoil 24 and a suction side edge 44 positioned proximate to a suction side 18 of the generally elongated, hollow airfoil 24. As shown in FIGS. 1 and 3, the pressure and suction side edges 42, 44 may be angled relative to the upper surface 22 to control the escape of cooling fluids between platforms 16 of adjacent turbine airfoils 10.

In one embodiment, the suction side edge 44 may be positioned at an acute angle 47 relative to a longitudinal axis 46 of the platform 16 where the suction side edge 44 is formed from a single surface. For instance, the suction side edge 44 may be positioned at an angle between about 30 and about 45 degrees. In another embodiment, as shown in FIG. 3, the suction side edge 44 may be positioned at an obtuse angle 43 relative to the upper surface 22 of the platform 16. The obtuse angle 43 may be between about 120 degrees and about 135 degrees. The turbine airfoil 10 may include a suction side edge 44 formed from a first surface 48 positioned at an obtuse angle 49 relative to the upper surface 22 of the platform 16 and a second surface 50 positioned at an obtuse angle relative to a bottom surface 52 of the platform 16 and intersecting the first surface 48 such that the first and second surfaces 48, 50 are positioned in different planes, as shown in FIG. 3. The pressure side edge 54 of an adjacent turbine airfoil 10 may be positioned at an acute angle relative to an upper surface 56 of the platform 58 so that the pressure side edge 54 may mate with the suction side edge 44. Also, the pressure side edge 42 may be positioned at an acute angle 51 relative to the upper surface 22. In one embodiment, the pressure side edge 42 may be positioned at an acute angle such that the pressure side edge 42 is aligned with the suction side edge 44. In other embodiments, the orientation of the suction and pressure side edges 44, 54 may differ.

Figure 4:
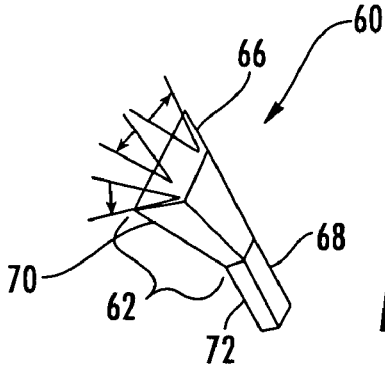
FIG. 4 is a schematic perspective view of a film cooling slot with a diffusion portion on the suction side edge of the platform shown in FIG. 3.

The turbine airfoil 10 may also include one or more film cooling slots 60 for cooling the platform 16 and allowing cooling fluids to form a film cooling boundary layer proximate to the upper surface 22. In one embodiment, the film cooling slots 60 may be positioned on the first surface 48. The film cooling slots 60 may extend for all of or a portion of the suction or pressure side edges 44, 42, or both, and may extend from the bottom surface 52 to the upper surface 22. The film cooling slots 60 may also include a diffusion portion 62 positioned adjacent to the upper surface 22 of the platform 16. The diffusion portion 62 may include side walls 64 at angles relative to sidewalls 66 forming the film cooling slots 60 to decrease the velocity of the cooling fluids flowing therethrough to reduce disruption of the layer of film cooling fluids proximate to the upper surface 22 of the platform 16 and the upper surface 56 of the adjacent platform 58. The diffusion portion 62 have an ever increasing cross-sectional area moving in a direction from the bottom surface 52 to the upper surface 22. As shown in FIG. 3, the diffusion portion 62 may include a first backside wall 64 angled between about five degrees and about twenty five degrees from the first surface 48. In one embodiment, the first backside wall 64 may be about ten degrees from the first surface 48. As shown in FIG. 4, the diffusion portion 62 may also include a first angled sidewall 66 angled between about five degrees and about twenty five degrees from a first sidewall 68 of the film cooling slot 60. The diffusion portion 62 may also include a second angled sidewall 70 angled between about five degrees and about twenty five degrees from a second sidewall 72 of the film cooling slot 60 that is positioned generally opposite to the first sidewall 68 of the film cooling slot 60. In one embodiment, the first and second angled sidewalls 66, 70 may be angled at about ten degrees relative to the first and second sidewalls 68, 72.

Figure 5:
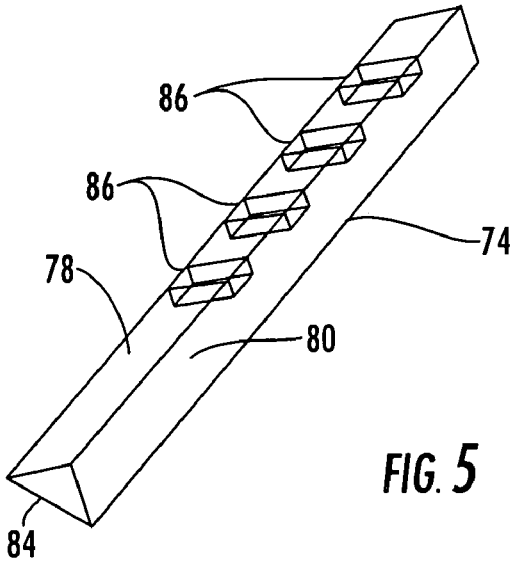
FIG. 5 is a perspective view of a damper shown in cross-section in FIG. 3.

The turbine airfoil 10 may also include one or more dampers 74, as shown in FIGS. 3 and 5, positioned between the second surface 50 adjacent to the bottom surface 52 of the platform 16 and a side surface 54 of the platform 58 of an adjacent turbine blade 10. The damper 74 may control the flow of cooling fluids through the gap 76 between the platforms 16, 58 of the turbine blades 10. As shown in FIGS. 3 and 5, the damper 74 may extend for all of or a portion of the intersection between two adjacent platforms 16, 58. As shown in FIG. 3, the damper 74 may have a suction side surface 78 that is generally aligned with the second surface 50 of the suction side edge 44 and may have a pressure side surface 80 that is generally aligned with a side surface 82 of a pressure side edge 54 of an adjacent turbine blade. In at least one embodiment, the damper 74 may have a generally triangular cross-section, as shown in FIG. 3. The damper 74 may also include a bottom surface 84 that may be generally flush with the bottom surface 52 of the platform 16.

The damper 74 may also include one or more cooling slots 86, as shown in FIGS. 3 and 5, positioned on the suction side surface 78 and extending generally parallel to the suction side surface 78 of the damper 74. The cooling slots 52 may or may not be positioned generally parallel to each other. The cooling slots 52 may extend from the bottom surface 84 to the pressure side surface 80. The cooling slots 52 may be generally rectangular or have another appropriately shaped cross-section.

During use, the damper 74 may substantially block the flow of cooling fluids through the gap 76 between adjacent platforms 16, 58. The cooling fluids may flow through the cooling slots 86 and the gap 76 proximate to the second surface 50. The cooling fluids then impinge on the pressure side edge 54 to provide backside impingement cooling for the platform 58. The cooling fluids may then flow proximate to the first surface 48 through the gap 76 and the film cooling slots 60. As the cooling fluids flow through the diffusion portions 62 of the film cooling slots 60, the velocity of the cooling fluids is reduced because of the increasing cross-sectional areas of the diffusion portions 62 of the film cooling slots 60 moving toward the upper surface 22. The diffusion portions 62 also enable the cooling fluids to be exhausted at a shallow angle relative to the upper surface 22 of the platform 16. The cooling fluids may then flow out of the gap 76 and form a layer of film cooling fluids proximate to the upper surface 22 of the platform 16 and the upper surface 56 of the platform 58. This configuration produces a good film sub-layer with a high local film effectiveness level and minimizes the local heat transfer coefficient augmentation due to film blowing effect.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

a platform positioned at an intersection of the generally elongated, hollow airfoil and the root, wherein the platform includes a leading edge, a trailing edge opposite the leading edge, a pressure side edge positioned proximate to a pressure side of the generally elongated, hollow airfoil and a suction side edge positioned proximate to a suction side of the generally elongated, hollow airfoil;

wherein the suction side edge is positioned at an acute angle relative to a longitudinal axis of the platform; and wherein the suction side edge is formed from at least two surfaces, a first surface positioned at an obtuse angle relative to an upper surface of the platform and a second surface positioned at an obtuse angle relative to a bottom surface of the platform and intersecting the first surface such that the first and second surfaces are positioned in different planes.

2. The turbine airfoil of claim 1, wherein the first surface comprises at least one film cooling slot.

3. The turbine airfoil of claim 2, wherein the at least one film cooling slot further comprises a diffusion portion positioned adjacent to the upper surface of the platform.

4. The turbine airfoil of claim 3, wherein the diffusion portion comprises a first backside wall angled between about five degrees and about twenty five degrees from the first surface.

5. The turbine airfoil of claim 4, wherein the diffusion portion comprises a first backside wall angled about ten degrees from the first surface.

6. The turbine airfoil of claim 3, wherein the diffusion portion comprises a first angled sidewall angled between about five degrees and about twenty five degrees from a first sidewall of the at least one film cooling slot.

7. The turbine airfoil of claim 6, wherein the diffusion portion comprises a second angled sidewall angled between about five degrees and about twenty five degrees from a second sidewall of the at least one film cooling slot that is positioned generally opposite to the first sidewall of the at least one film cooling slot.

8. The turbine airfoil of claim 7, wherein the first and second angled sidewalls are angled at about ten degrees relative to the first and second sidewalls.

9. The turbine airfoil of claim 1, further comprising at least one damper positioned between the second surface adjacent to the bottom surface of the platform and a side surface of a platform of an adjacent turbine blade.

10. The turbine airfoil of claim 9, wherein the at least one damper has a suction side surface that is generally aligned with the second surface of the suction side edge and has a pressure side surface that is generally aligned with a side surface of a platform of an adjacent turbine blade.

11. The turbine airfoil of claim 10, further comprising at least one cooling slot positioned in the suction side surface and extending generally parallel to the suction side surface of the at least one damper.

12. The turbine airfoil of claim 1, wherein the pressure side edge is positioned at an acute angle relative to an upper surface of the platform.

13. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

a platform positioned at an intersection of the generally elongated, hollow airfoil and the root, wherein the platform includes a leading edge, a trailing edge opposite the leading edge, a pressure side edge positioned proximate to a pressure side of the generally elongated, hollow airfoil and a suction side edge positioned proximate to a suction side of the generally elongated, hollow airfoil;

wherein the suction side edge is positioned at an acute angle relative to a longitudinal axis of the platform;

at least one damper positioned at least partially in a groove between the suction side edge and a pressure side edge of an adjacent turbine airfoil; and wherein the suction side edge is formed from at least two surfaces, a first surface positioned at an obtuse angle relative to an upper surface of the platform and a second surface positioned at an obtuse angle relative to a bottom surface of the platform and intersecting the first surface such that the first and second surfaces are positioned in different planes.

14. The turbine airfoil of claim 13, wherein the first surface comprises at least one film cooling slot.

15. The turbine airfoil of claim 14, wherein the at least one film cooling slot further comprises a diffusion portion positioned adjacent to the upper surface of the platform.

16. The turbine airfoil of claim 15, wherein the diffusion portion comprises a first backside wall angled between about five degrees and about twenty five degrees from the first surface, a first angled sidewall angled between about five degrees and about twenty five degrees from a first sidewall of the at least one film cooling slot, and a second angled sidewall angled between about five degrees and about twenty five degrees from a second sidewall of the at least one film cooling slot that is positioned generally opposite to the first sidewall of the at least one film cooling slot.

17. The turbine airfoil of claim 16, wherein the first backside wall is angled about ten degrees from the first surface and the first and second angled sidewalls are angled at about ten degrees relative to the first and second sidewalls.

18. The turbine airfoil of claim 13, wherein the at least one damper has a suction side surface that is generally aligned with a side of the suction side edge and has a pressure side that is generally aligned with a side surface of a pressure side edge of an adjacent turbine blade and further comprises at least one cooling slot positioned in the suction side surface.

* * * * *